US007673596B2

(12) United States Patent
Bonner

(10) Patent No.: US 7,673,596 B2
(45) Date of Patent: Mar. 9, 2010

(54) SIX-CYCLE INTERNAL COMBUSTION ENGINE

(76) Inventor: M. Jeffrey Bonner, 3790 1st Ave. NW., Naples, FL (US) 34120

( * ) Notice: Subject to any disclaimer, the term of this patent is extended or adjusted under 35 U.S.C. 154(b) by 18 days.

(21) Appl. No.: 12/077,962

(22) Filed: Mar. 24, 2008

(65) Prior Publication Data

US 2009/0235881 A1 Sep. 24, 2009

(51) Int. Cl.
*F02B 75/02* (2006.01)
*F02B 47/08* (2006.01)

(52) U.S. Cl. ..... 123/64

(58) Field of Classification Search ..... 123/64
See application file for complete search history.

(56) References Cited

U.S. PATENT DOCUMENTS 6,688,293 B2 * 2/2004 Urushihara et al. .... 123/568.13
7,472,696 B2 * 1/2009 Easley et al. ..... 123/568.21

* cited by examiner

*Primary Examiner*—Noah Kamen
(74) *Attorney, Agent, or Firm*—Gold & Rizvi, P.A.; H. John Rivzi; Glenn E. Gold

(57) ABSTRACT

Described is a six-cycle internal combustion engine. Four of the cycles are the standard "Otto" cycles, namely intake, compression, power and exhaust plus two additional cycles, a primary intake cycle and a transfer cycle. The two additional cycles act as a supercharger to provide compressed air to the intake port of the "Otto" cycle. The benefit is reduced fuel consumption due to 1 power stroke per every 3$^{rd}$ crankshaft revolution and the ability to vary the intake pressure and create a more favorable torque curve at low to mid RPM.

21 Claims, 3 Drawing Sheets

SIX-CYCLE INTERNAL COMBUSTION ENGINE

BACKGROUND OF THE INVENTION

The purpose of the invention and the six-cycle engine is to provide a more fuel efficient engine. The design of the engine is very similar to the standard "Otto" cycle which, of course, is well known. The "Six Stroke" was coined by the inventor of the Beare Head. The technology combines a four stroke engine bottom with an opposed piston in the head working at half the cycle of the bottom piston. The head piston works in a ported cylinder closely resembling that of a two stroke, 4+2=Six stroke. A six Stroke engine describes a number of different approaches in the internal combustion engine to capture the waste heat from the four stroke Otto cycle and use it to power an additional power and exhaust stroke of the piston.

U.S. Pat. No. 1,068,173 to Schimanek discloses a combustion engine in which there is combined with the usual combustion chamber, a storage receptacle for increasing the power of the working stroke of the piston.

U.S. Pat. No. 3,964,263 to Tibbs discloses a reciprocating piston engine of the type including a piston reciprocal in a cylinder toward and away from an expansion chamber at one end of a the cylinder and is also provided with intake and exhaust valves openable and closable in timed sequence with the reciprocation of the piston. During a fourth stroke of the piston, a readily vaporizable liquid is injected into the expansion chamber under pressure for flashing into vapor upon being heated by the residual heat of combustion in the expansion chamber and during the fifth and sixth stroke of the piston.

U.S. Pat. No. 4,289,097 to Ward illustrates a six cycle engine. The six cycles are a first intake stroke, a second intake stroke, a compression and combining stroke, the power stroke and the exhaust stroke. This engine provides for some of the fuel's energy that is ordinarily lost in the engine's cooling system, by absorbing heat after the first stroke and subsequently using it in the power stroke.

U.S. Pat. No. 4,917,054 illustrates a six stroke internal combustion engine wherein the six strokes are the admission of air, a first compression accompanied or followed by a possible cooling, a second compression followed by a combustion, a first expansion producing a usable work, the second expansion also producing a usable work and finally the discharge of the combustion gases.

U.S. Pat. No. 4,924,823 to Ogura et al demonstrates an internal combustion engine which generally utilizes a conventional four stroke process including an intake stroke, compression stroke, expansion stroke and an exhaust stroke. In addition to the four strokes a secondary process is being used having two additional strokes for scavenging the combustion with fresh air. This two stroke scavenging process employs a fresh air intake stroke and a fresh air exhaust stroke to exhaust any remaining burnt or unburnt gases from the combustion chamber.

U.S. Pat. No. 6,311,651 to Singh discloses an internal combustion engine which is designed to operate on a six stroke cycle in which there is one cycle for injecting water into the cylinder during a predetermined portion of the cycle. Included is a central processor which is responsive to signals received from a sensor assembly mounted on the internal combustion engine at strategic locations.

U.S. Pat. No. 6,789,513 to Ziabazmi illustrates a six stroke internal combustion engine with intake-exhaust valves. All valves in the combustion chamber are named intake-exhaust valves because the valves function as both intake valves in an intake stroke and an exhaust stroke. In this engine, each cycle comprises an intake stroke, an exhaust stroke, a power stroke, an exhaust stroke, the fifth and the sixth stroke. There is an interval between the exhaust stroke and the intake stroke of the next cycle. The interval includes strokes five and six. During the exhaust stroke and the interval, all gases are expelled from the cylinder and the cylinder head completely before the intake stroke of the next cycle begins.

U.S. Pat. No. 7,143,725 Lung Tan Hu illustrates a dual six-stroke self cooling engine which utilizes a turbo and a cooling cylinder to compress cool air into the engine head and reduce the engine temperature.

BRIEF DESCRIPTION OF THE INVENTION

The basic inventive concept for the new six cycle engine is that the engine has a power stroke every third revolution. The extra two cycles are used to draw air into the cylinder on the down stroke and then force the air into a common plenum which feeds air and fuel into the engine. The two extra cycles act as the engine supercharger. This engine completes all cycles in three revolutions of the crankshaft which includes one fuel induction event per 3 revolutions, as compared to one fuel induction per two revolutions with the "Otto" cycle. Therefore, fuel is conserved. An additional benefit of this design is that the intake plenum or conduit pressure is adjustable via an air intake conduit valve setting and an opening rate to provide positive pressure at any engine RPM. The increased intake plenum or conduit pressure yields significantly greater low RPM engine torque and allows the designer to configure the drive train for more efficient operation at this lower RPM. Other advantages will be apparent as the description continues.

DETAILED DESCRIPTION OF THE INVENTION

Figure 1:
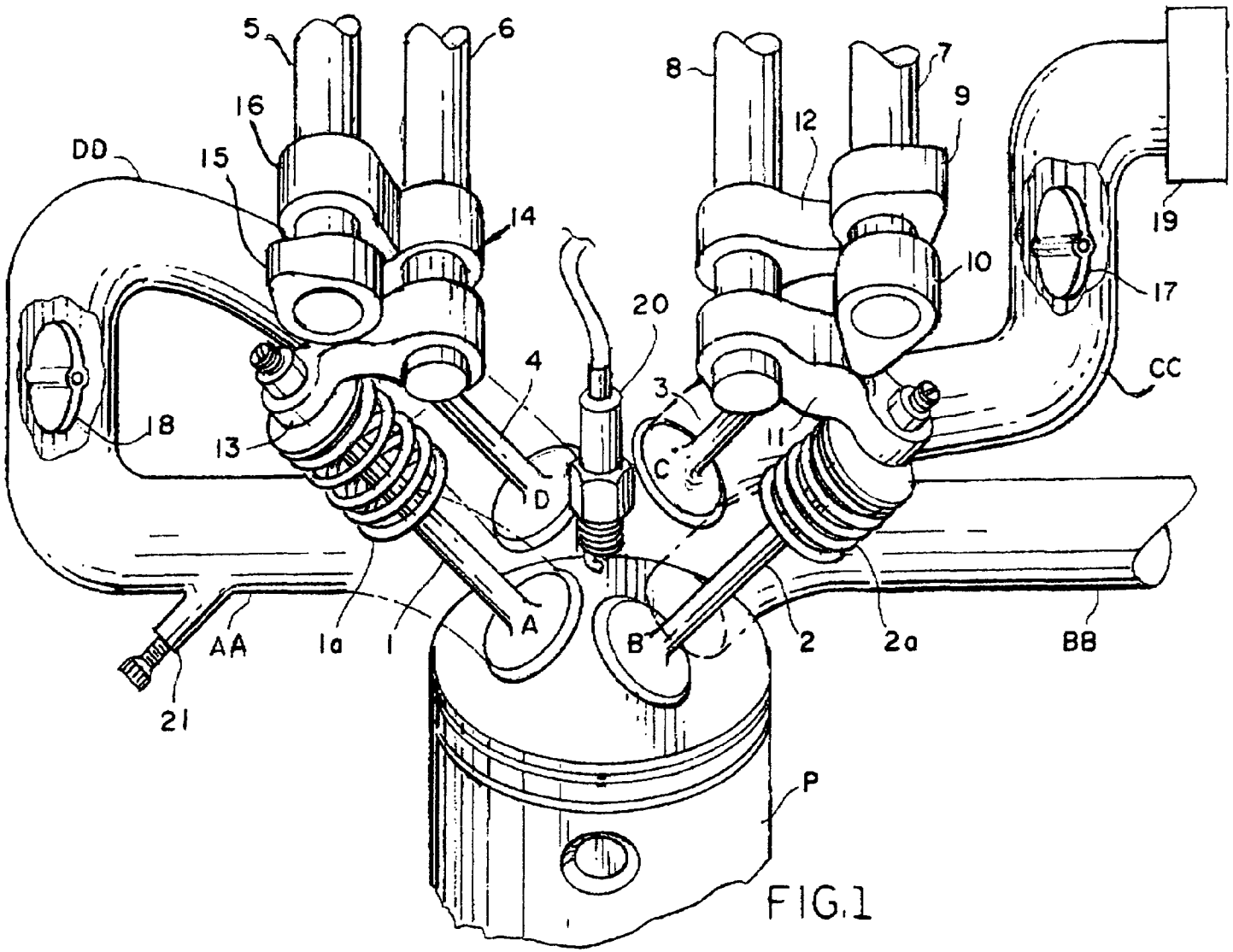
FIG. 1 is a perspective view of the basic elements of the six-cycle engine.

FIG. 1 shows the various elements of the six-cycle engine wherein the piston is shown at P. There are four valves marked A, B, C and D. Each of the valves have a valve stem marked 1, 2, 3 and 4. The valve stems 1 and 2 have the valve stem springs 1*a* and 2*a*, respectively. Such layout so far as well known as a piston and cylinder combination having a minimum of four valves assigned to each cylinder. As is well known in such an engine two of the valves operate in unison or simultaneously in different cycles which is controlled by camshafts. As the description continues, it will be shown that the various valves do not operate in unison but sequentially or independently from each other. As seen in this FIG. 1, there is a left camshaft 5 and a rocker arm shaft 6. On the right side of this FIG., there is a camshaft 7 and a rocker arm shaft 8. On the right camshaft 7 there are mounted cams or lobes 9 and 10 which are offset from each other by 90 or more degrees which operate on the rocker arms 11 and 12, respectively. The same arrangement can be seen in the left camshaft 5 having the cams or lobes 15 and 16 thereon which are also offset from each other by 90 degrees or more which operate on the rocker arms 13 and 14, respectively. Various conduits or tubes or plenums are associated with each of the valves A, B, C and D.

Valves A and D are interconnected by the conduit DD. Valve B has assigned to it an exhaust conduit BB, while valve C has a conduit CC which is the air intake conduit including an air filter 19. Also in conduit CC there is a first conduit air valve 17 and the same or similar second conduit air valve 18 is located in the conduit DD. The purpose of these valves will be explained below under the heading of "operation". The spark plug 20 is located in the cylinder head (not shown). The fuel jet 21 is located in the conduit AA. This is the basic layout of the inventive six-cycle engine.

Figure 2:
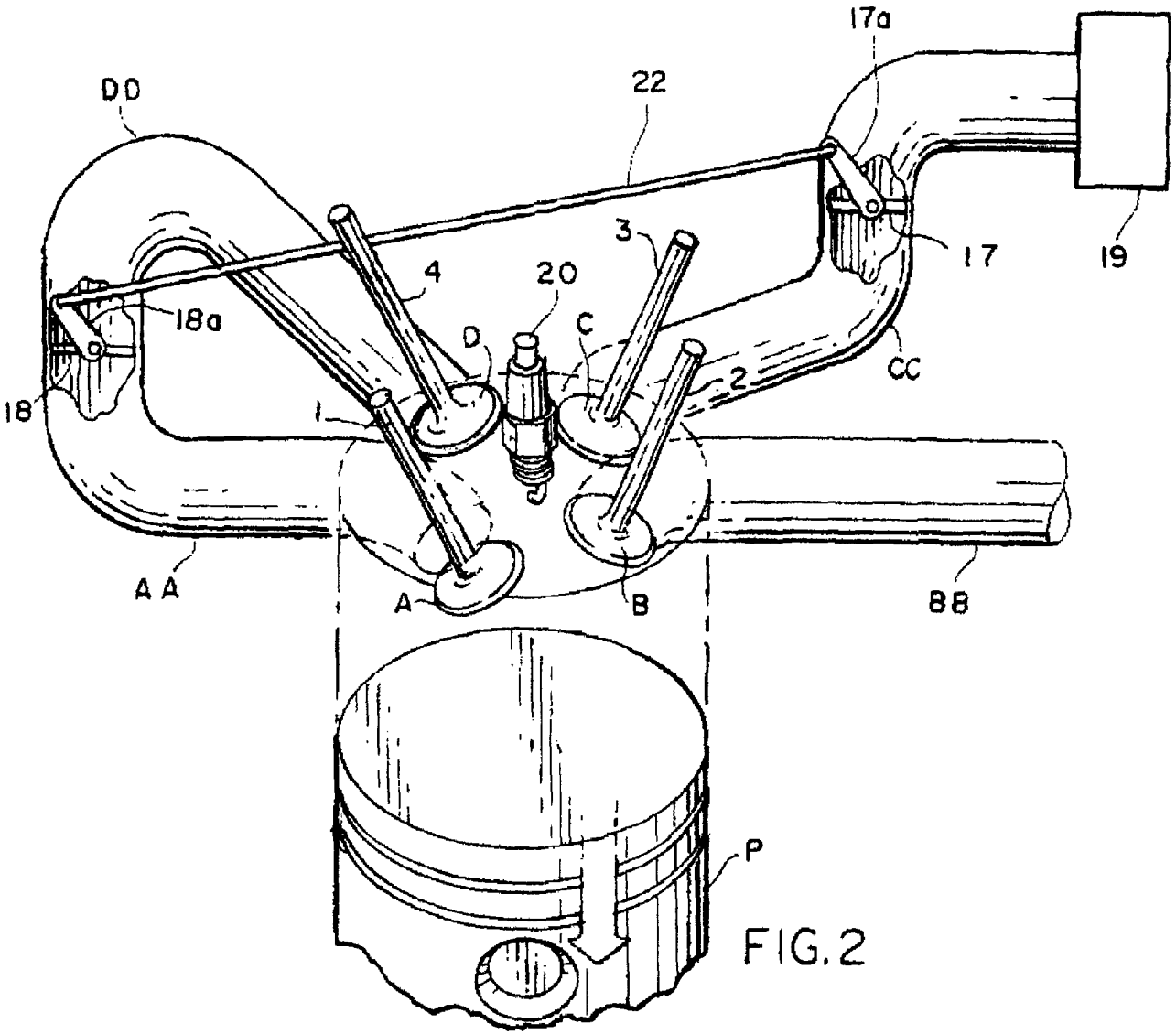
FIG. 2 is a perspective view of the engine of FIG. 1 in an operational Mode.

FIG. 2 is another perspective view of the basic view of the six-cycle engine of FIG. 1 in more of a schematic view. It should be noted that the same reference characters have been used as were used in explaining FIG. 1. Also it should be noted that that the two conduit valves 17 and 18 are interconnected by a linkage 22 so that the two conduit valves 17 and 18 can operate in unison. When conduit valve 17 is closed so will be the conduit valve 18 being closed. On the outside of the tubing CC there is a valve lever 17*a* which operates on the pivot shaft of the valve 17 and so does the lever 18*a* operating the pivot shaft of the valve 18. The linkage 22 operating the valves 17 and 18 is operated by the gas pedal of the vehicle. In a more automated setting, the valves could be operated by servo motors.

OPERATION

Figure 3:
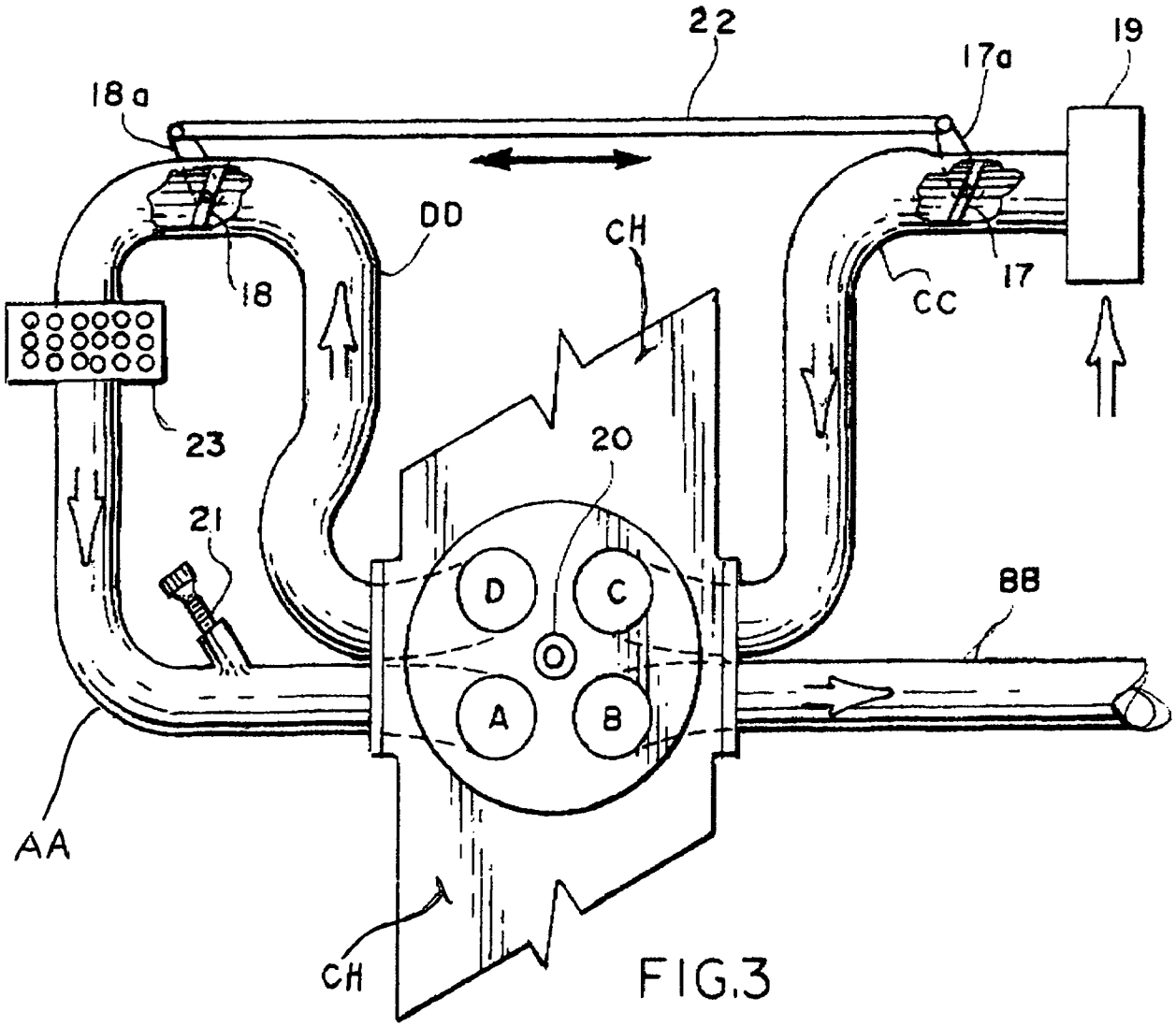
FIG. 3 is a bottom view of the engine layout.

FIG. 3 is a bottom view of the six-cycle engine. The operation of this six-cycle engine will now be explained by having reference to FIG. 3 where like reference characters are being used as were in the previous FIGS. 1 and 2. The valves A-D are operating in the cylinder head CH.

The cycle begins with the piston P at top dead top center (TDC). The exhaust cycle has just been completed.

The primary intake valve C opens as the piston P starts in its downward movement. The suction created by the piston P moving down causes air to be drawn through the filter 19 past the first conduit air valve 17 and through the conduit CC to thereby fill the space above the piston P. The amount of air that moves into the space above the piston P is a function of the primary intake valve C opening rate and height and duration, conduit valve 17 bore diameter of the conduit CC and the rotational position of the conduit valve 17. The primary intake valve C closes at approximately bottom dead center (BDC) of the piston P.

The First Cycle is Now Complete.

The transfer valve D starts to open at approximately BDC of the piston P. The transfer valve D continues to open as the piston P moves toward the TDC position. This upward movement of the piston P causes the trapped air above the piston P to be forced through the transfer valve D into the conduit DD and further through the conduit AA, which is connected to the intake valve A. The valve opening characteristics of the transfer valve D are designed such that the maximum amount of air above the piston P is moved through the conduit DD and further into the conduit AA that connects to the secondary intake valve A.

The Second Cycle is Now Complete.

The secondary intake valve A opens at approximately the piston's TDC. The piston P now moves downward and causes the air within the conduit DD to flow past the second conduit air valve 18 and the heat exchanger 23 within the conduit DD. The second conduit air valve's 18 rotational position determines the engine speed most likely under the influence of the gas pedal. The heat exchanger 23 removes any heat that has accumulated from the compression of the air from cycle 2 above. An optional fan can blow air across the heat exchanger to remove the heat (not shown). Fuel is now introduced by way of the fuel jet into the air stream of the conduit AA and enters the combustion chamber through the secondary intake valve A. The amount of air that enters the combustion chamber is determined by the secondary valve's A opening profile, the rotational position of the conduit valve 18 and the amount of positive air pressure within the conduits DD and AA (along with other variables mentioned previously). The secondary intake valve A now closes at the piston's BDC position.

The Third Cycle is Now Complete.

The piston P now moves upward on the compression stroke of the cycle compressing the air fuel mixture above the piston. (This is standard in the "Otto" cycle).

The Fourth Cycle is Now Complete.

Ignition occurs at approximately TDC.

The piston P now moves downward on the power stroke. This cycle is just like the standard "OTTO" cycle.

The Fifth Cycle is Now Complete.

The exhaust valve B opens at approximately the piston's BDC and the spent gasses are expelled into the atmosphere as the piston moves upward into its TDC position. This cycle is just like the standard "Otto" cycle.

The Sixth Cycle is Now Complete

It is also to be noted that conduit air valves 17 and 18 are connected with a linkage 22 or other synchronization mechanisms such that rotational motion of one creates a similar rotational motion of the other. This synchronization guarantees positive air pressure within the conduits DD and AA leading from transfer valve D to secondary intake valve A.

The first conduit air valve 17 can be manipulated to offer maximum cylinder pressure for a given fuel type since some alternative fuels, like alcohols, resist detonation under very high engine compression ratios.

Positive air pressure within the secondary intake conduit AA produces higher than normal air flow and fuel flow into the engine during the filling stage. This higher air flow consumes somewhat increased fuel usage at a given RPM but the overall effect is that increased engine torque is available at a lower RPM. This lower operating RPM coupled with a more conservative output gearing results in an overall reduced operating fuel consumption rate.

Below are a few typical scenarios for this style engine fitted to an automobile.

At idle, fuel consumption is reduced because of the fact that there is only 1 fuel event per 3 crankshaft revolutions.

Upon acceleration, from a stop, the accelerator pedal in the 1 in 3 power stroke engine is depressed only slightly to get the vehicle moving because of the increased torque at low RPM. Fuel is conserved because the engine does not require heavy accelerator pedal positions and increased engine RPM for the same level of acceleration.

At steady engine speed, fuel is conserved because of the 1 in 3 power stroke as opposed to the 1 in 2 power stroke which is common in the "Otto" cycle engine. Fuel is injected once every $3^{rd}$ revolution of the crankshaft instead of once every other revolution of the crankshaft. Fuel is further conserved since the output gearing is more conservative in the 1 in 3 power stroke engine which operates at less engine RPM for a given comparable vehicle speed due to increased low RPM torque.

It is important to know that in a six stroke engine there are 4 valves at a minimum assigned to each of the cylinders. However, the valves do not operate in unison but are operating independently from each other. On the camshaft the rocker arms are operated by cam lobes which are offset from each other by at least 90 degrees. This then, results in the fact that each valve has its own cam lobe that opens and closes independently of the other valves but such opening and closing is in synchronization with the crankshaft of the engine by way of timing belts or chains.

Engines that use different types of fuels can benefit from this design. The intake plenum or conduit pressure can be tailored to suit the needs of the fuel which is chosen. Some fuels, such as diesel and alternate fuels such as bio-diesel and alcohol, can tolerate much higher operating pressures as compared to gasoline. These higher cylinder pressures yield increased engine efficiency without the risk of engine damage from detonation. Higher efficiency engines yield higher power output for a given amount of fuel consumed.

What I claim is:

1. An internal combustion engine having at least one camshaft to operate a minimum of four independently moving valves per one cylinder of said engine, said valves comprise one primary intake valve, one transfer valve, one secondary intake valve and one exhaust valve;

a first conduit that feeds atmospheric air to said primary intake valve;

a transfer second conduit connecting said transfer valve and said secondary intake valve;

a conduit first air valve is located within said first conduit;

a conduit second air valve located within said transfer second conduit; and a means for connecting said first and said second conduit air valves to operate in unison.

2. The internal combustion engine of claim 1, wherein said means for connecting is a linkage bar.

3. The internal combustion engine of claim 1, the engine further comprising an air filter located at an entrance to said first conduit.

4. The internal combustion engine of claim 1, the engine further comprising a heat exchanger in thermal communication with the transfer second conduit.

5. An internal combustion engine having at least one camshaft to operate a minimum of four independent, asynchronously moving valves per one cylinder of said engine, said valves comprise one primary intake valve, one transfer valve, one secondary intake valve and one exhaust valve;

an airflow transfer conduit disposed in airflow communication between the transfer valve and the secondary intake valve for transferring air from the transfer valve to the secondary intake valve; and a transfer conduit air valve disposed within the airflow transfer conduit controlling airflow within the airflow transfer conduit, between the two valves and controlling airflow into the secondary intake valve.

6. The internal combustion engine of claim 5, wherein the transfer conduit air valve is a butterfly valve.

7. The internal combustion engine of claim 5, the engine further comprising an atmosphere airflow conduit in airflow communication feeding atmospheric air to the primary intake valve.

8. The internal combustion engine of claim 7, the engine further comprising an atmosphere conduit air valve disposed within the atmosphere airflow conduit controlling airflow to the primary intake valve.

9. The internal combustion engine of claim 8, wherein the transfer conduit air valve and the atmosphere conduit air valve are each operated by a respective electro-mechanical control device.

10. The internal combustion engine of claim 8, wherein the transfer conduit air valve and the atmosphere conduit air valve are controlled to operate in unison.

11. The internal combustion engine of claim 10, wherein the transfer conduit air valve and the atmosphere conduit air valve are controlled via a mechanical linkage coupled to each of the transfer conduit air valve and the atmosphere conduit air valve.

12. The internal combustion engine of claim 5, the engine further comprising a heat exchanger in thermal communication with the transfer airflow conduit.

13. An internal combustion engine comprising:

a piston provided within a cylinder;

a minimum of four independent, asynchronously moving valves per one cylinder of said engine, said valves comprise a least one of each of the following valves: one primary intake valve, one transfer valve, one secondary intake valve and one exhaust valve; and at least one camshaft to operate the minimum of four independently moving valves;

wherein all valves remain closed except wherein the valves operate in accordance with the following sequence:

the primary intake valve is open during a first downward stroke of the piston;

the transfer valve is open only during a first upward stroke of the piston;

the secondary intake valve is open during a second downward stroke of the piston;

all valves are closed during a second upward, compression stroke of the piston;

all valves are closed during a third down downward, power stroke of the piston; and the exhaust valve is open only during a third upward, exhaust stroke of the piston.

14. The internal combustion engine of claim 13, the engine further comprising a transfer conduit providing airflow communication between the transfer valve and the secondary intake valve.

15. The internal combustion engine of claim 14, the engine further comprising a transfer conduit air valve disposed within the transfer conduit, wherein the transfer conduit air valve controls airflow within the transfer conduit between the transfer valve and the secondary intake valve.

16. The internal combustion engine of claim 15, the engine further comprising an atmospheric air conduit being in airflow communication with the primary intake valve.

17. The internal combustion engine of claim 16, the engine further comprising an atmosphere conduit air valve disposed within the atmosphere air conduit, wherein the atmosphere conduit air valve controls airflow to the primary intake valve.

18. The internal combustion engine of claim 17, wherein the transfer conduit air valve and the atmosphere conduit air valve are each operated by a respective electro-mechanical control device.

19. The internal combustion engine of claim 17, wherein the transfer conduit air valve and the atmosphere conduit air valve are controlled to operate in unison.

20. The internal combustion engine of claim 19, wherein the transfer conduit air valve and the atmosphere conduit air valve are controlled via a mechanical linkage coupled to each of the transfer conduit air valve and the atmosphere conduit air valve.

21. The internal combustion engine of claim 13, the engine further comprising a heat exchanger in thermal communication with the transfer airflow conduit.

* * * * *